US006694685B2

(12) United States Patent
Celata

(10) Patent No.: US 6,694,685 B2
(45) Date of Patent: Feb. 24, 2004

(54) SYSTEM AND COMPONENTS FOR FRAMING WOODEN STRUCTURES

(76) Inventor: Richard Celata, 78 Clifton Ave., Saugus, MA (US) 01906

( * ) Notice: Subject to any disclaimer, the term of this patent is extended or adjusted under 35 U.S.C. 154(b) by 0 days.

(21) Appl. No.: 10/166,534

(22) Filed: Jun. 10, 2002

(65) Prior Publication Data

US 2003/0226325 A1 Dec. 11, 2003

(51) Int. Cl.[7] ..... E04H 3/00; E04C 2/34; E04C 1/00

(52) U.S. Cl. ..... 52/241; 52/481.1

(58) Field of Search ..... 52/578, 481.1, 52/241, 238.1, 317, 105, 733.2, 733.3; 446/105, 106, 124

(56) References Cited

U.S. PATENT DOCUMENTS

| | | | | | |
|---|---|---|---|---|---|
| 1,564,393 | A | | 12/1925 | York | |
| 2,000,897 | A | | 5/1935 | Alcott | |
| 2,105,327 | A | * | 1/1938 | McNamara | 52/250 |
| 2,281,402 | A | | 4/1942 | Wilson , Jr. et al. | |
| 2,294,139 | A | | 8/1942 | Strong | 72/118 |
| 2,297,056 | A | | 9/1942 | Gunnison | 20/4 |
| 2,380,834 | A | | 7/1945 | Goldman | 20/4 |
| 2,412,242 | A | | 12/1946 | Beaud | 20/2 |
| 2,473,017 | A | | 6/1949 | Edwards | 20/4 |
| 3,293,820 | A | | 12/1966 | Smith | 52/589 |
| 3,466,821 | A | | 9/1969 | O'Shaughnessy et al. | 52/204 |
| 3,733,755 | A | | 5/1973 | Butler | 52/36 |
| 3,851,372 | A | | 12/1974 | Wirch | 29/428 |
| 4,000,594 | A | * | 1/1977 | Kirk, Jr. | 52/241 |
| 4,164,832 | A | | 8/1979 | Van Zandt | 52/593 |
| 4,656,797 | A | | 4/1987 | Marquart | 52/169 |
| 5,819,498 | A | * | 10/1998 | Geraci | 52/745.1 |
| 5,921,047 | A | | 7/1999 | Walker | 52/585.1 |
| 6,209,282 | B1 | * | 4/2001 | Lafrance | 52/729.1 |
| 6,427,413 | B1 | * | 8/2002 | Lafrance | 52/578 |

* cited by examiner

*Primary Examiner*—Jeanette Chapman
(74) *Attorney, Agent, or Firm*—George A Herbster

(57) ABSTRACT

Components for constructing wooden frames for structures include top and bottom plates with transverse notches. The notches capture the ends of studs and tongues formed that extend from the ends of posts. The overall plate thickness equals a nominal plate thickness plus depth of the notch. For example, with two-by-fours and two-by-sixes, the actual plate thickness is 1½" lumber thickness plus ½" for notch depth. That is, the plate has an actual thickness of 2".

10 Claims, 8 Drawing Sheets

SYSTEM AND COMPONENTS FOR FRAMING WOODEN STRUCTURES

BACKGROUND OF THE INVENTION

1. Field of the Invention

This invention generally is related to framing for wooden structures and more specifically to a system of components for facilitating framing operations and for providing increased structural integrity.

2. Description of Related Art

Many buildings, including most residential homes, have wooden frames. Generally speaking a wooden frame comprises vertical spaced wooden studs extending between upper and lower wooden plates. Studs abut against counterfacing, horizontal plate surfaces and may be end-nailed or toe-nailed to the plates. In some structures metal brackets may fasten each end of a stud to its adjoining plate. Forming a wooden frame for a structure using conventional wooden plates and studs, particularly at a construction site, is labor intensive and can increase the construction costs for such structures.

It has been found that high wind conditions generate twisting forces on structures. With the ends of wooden studs butted against the top and bottom plates, this housing can cause the stud-to-plate fastening, in whatever conventional form, to fail. When this occurs, the structure is severely weakened and subject to damage or destruction.

From time to time, proposals have been made to provide wooden plates with mortise-like notches at each stud location. Examples of such specially prepared wooden plates are shown in:

| | | |
|---|---|---|
| 1,564,393 | (1925) | York |
| 2,000,897 | (1935) | Alcott |
| 2,281,402 | (1942) | Wilson |
| 2,297,056 | (1942) | Gunnison |
| 3,851,372 | (1974) | Wirch |

The York and Alcott patents are generally characterized by forming notches or mortises in specially formed or milled structures. The Wilson and Gunnison patents disclose double studs or stud portions that are designed to support cross members. The Wirch patent discloses conventional plates formed of conventional lumber with notches for receiving studs.

Typically plates in a wooden structure are formed of commercially available lumber. For example, residential houses plates are formed by two-by-four or two-by-six lumber. These values define a nominal dimension. However, the actual or measured thickness of standard two-by-four inch and two-by-six lumber is 1½ inches. Placing notches of any significant depth in standard wooden plates results in a tradeoff between the strength of the plate and the depth of a notch. For example, if a ½" deep notch is formed in a plate, the thickness of the plate at the notch is reduced by ⅓. Consequently while a notch tends to provide a stronger fastening between a stud and a plate, it comes at a cost of reducing the plate strength.

The foregoing patents disclose wall framing. The Wilson patent also discloses a conventional approach for forming a corner structure. In this case two studs are spaced. At an adjacent wall a two-by-four stud overlies the outer stud and spacers. This provides two 1½" perpendicular nailing surfaces at the corner. The Gunnison patent discloses specifically formed machined corner structures. Such specially machined structures can increase construction costs.

Notwithstanding these proposals, the framing for wooden structures generally continues to follow the conventional practice of end-nailing or toe-nailing studs to upper and lower plates. What is needed is a system of framing components that are readily manufactured, that facilitate construction to minimize construction cost and that improve the overall structural integrity even under severe atmospheric conditions.

SUMMARY

Therefore it is an object of this invention to provide a framing system with plates that facilitate framing operations.

Another object of this invention is to provide a framing system with components that provide increased structural integrity.

Yet another object of this invention is to provide a framing system that provides a structure that is less susceptible to failure when twisting, particularly under certain wind conditions.

In accordance with one aspect of this invention, a frame for a wooden structure includes wooden plates and studs wherein the studs have a length, width and thickness and the plates have a length and have a width corresponding to the width of the studs. In addition, the plates are formed from lumber having a nominal thickness specification with a plurality of transverse notches across the width of the plate for receiving the end of a stud. Each notch has a predetermined depth. The total plate thickness corresponds to the specified nominal plate thickness and the depth of the notch whereby the end of each stud is held within a notch in a finished frame.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
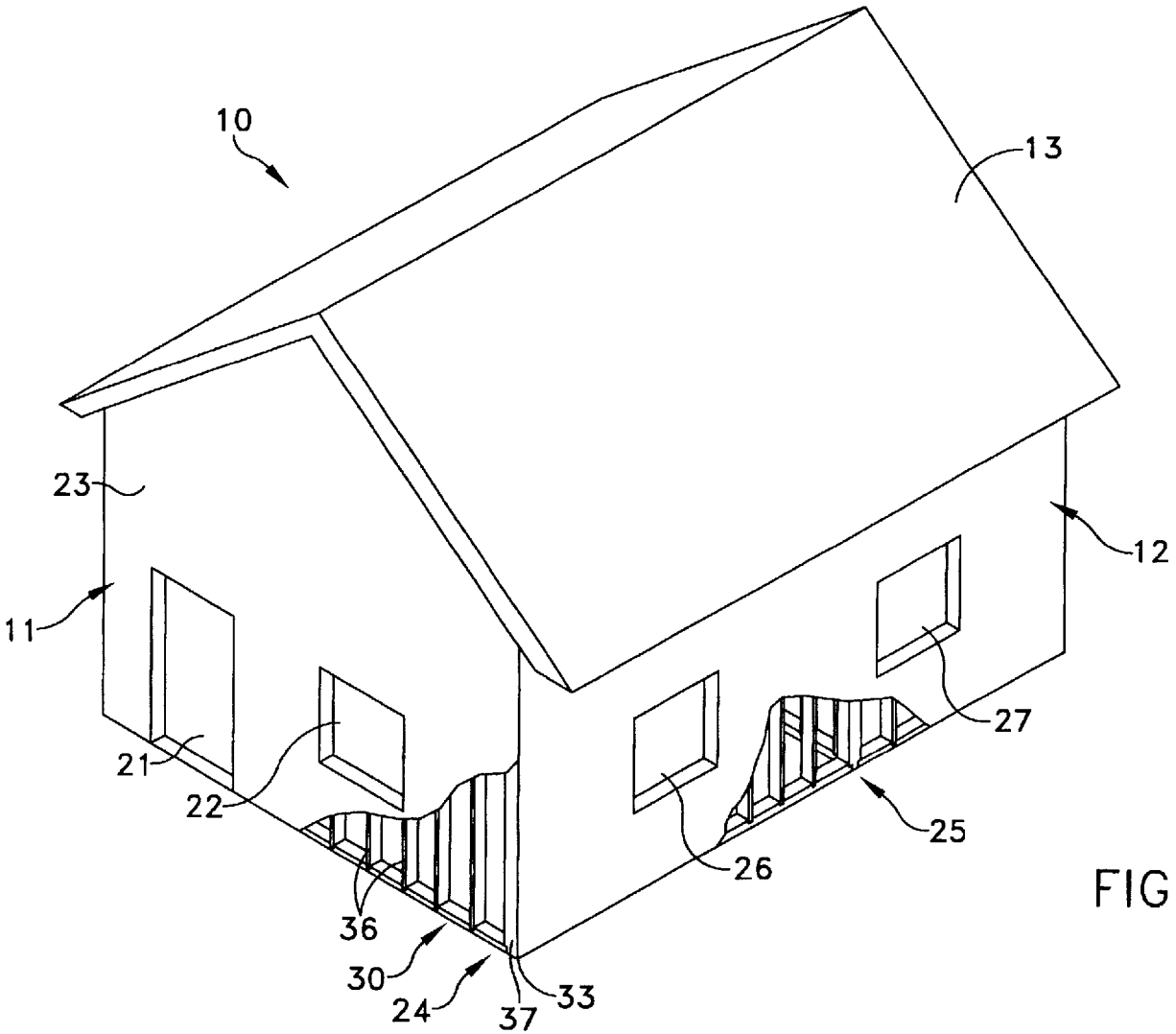
FIG. 1 is a perspective representation of a structure utilizing the framing system of this invention.

FIG. 1 depicts a representative structure 10 with a front wall 11, a side wall 12 and a roof 13. The wall 11 has a doorway 21 and a window 22 in the front wall 11 covered with sheathing 23. In FIG. 1 a portion of the sheathing 23 is deleted to expose the framing 24 at the front wall 11.

Another portion of the sheathing on the side wall 12 is deleted to expose a midwall 25 located between windows 26 and 27.

Figure 2:
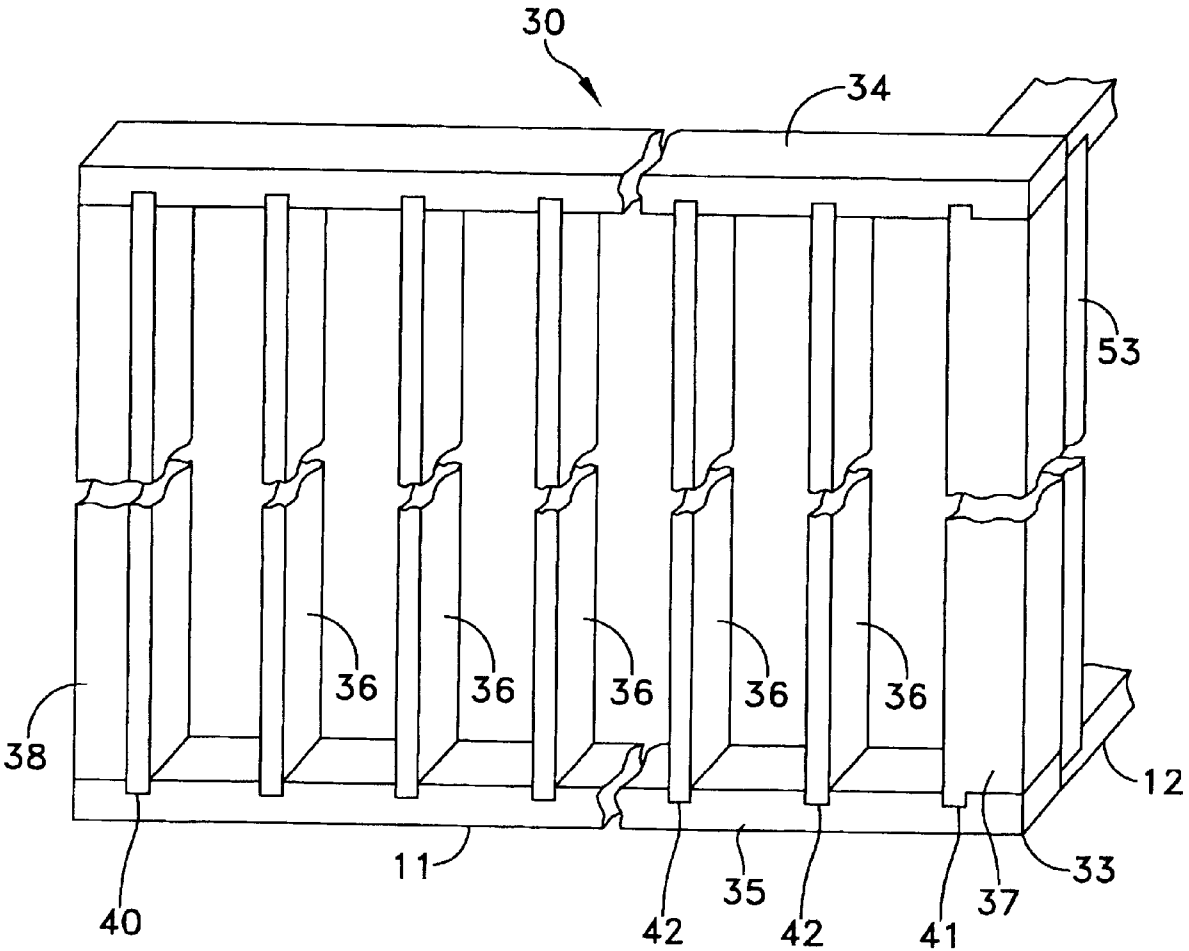
FIG. 2 is a perspective view, in detail of a portion of a wall framed in accordance with this invention.

FIG. 2 depicts a portion of a structure frame 30 with the framing for walls 11 and 12 extending at right angles from a corner 33. The wall 11 has a top plate 34 and bottom plate 35 constructed in accordance with this invention. Conventional studs 36, intermediate the opposite ends of the plates 34 and 35, maintain the spacing between the top and bottom plates 34 and 35. Corner posts 37 and 38 provide corner upright support. As will be apparent from FIGS. 2 and 3, and particularly FIG. 3, the bottom plate 35 rests at the edge 40 of flooring 41 that constitutes a conventional subfloor structure.

Figure 3:
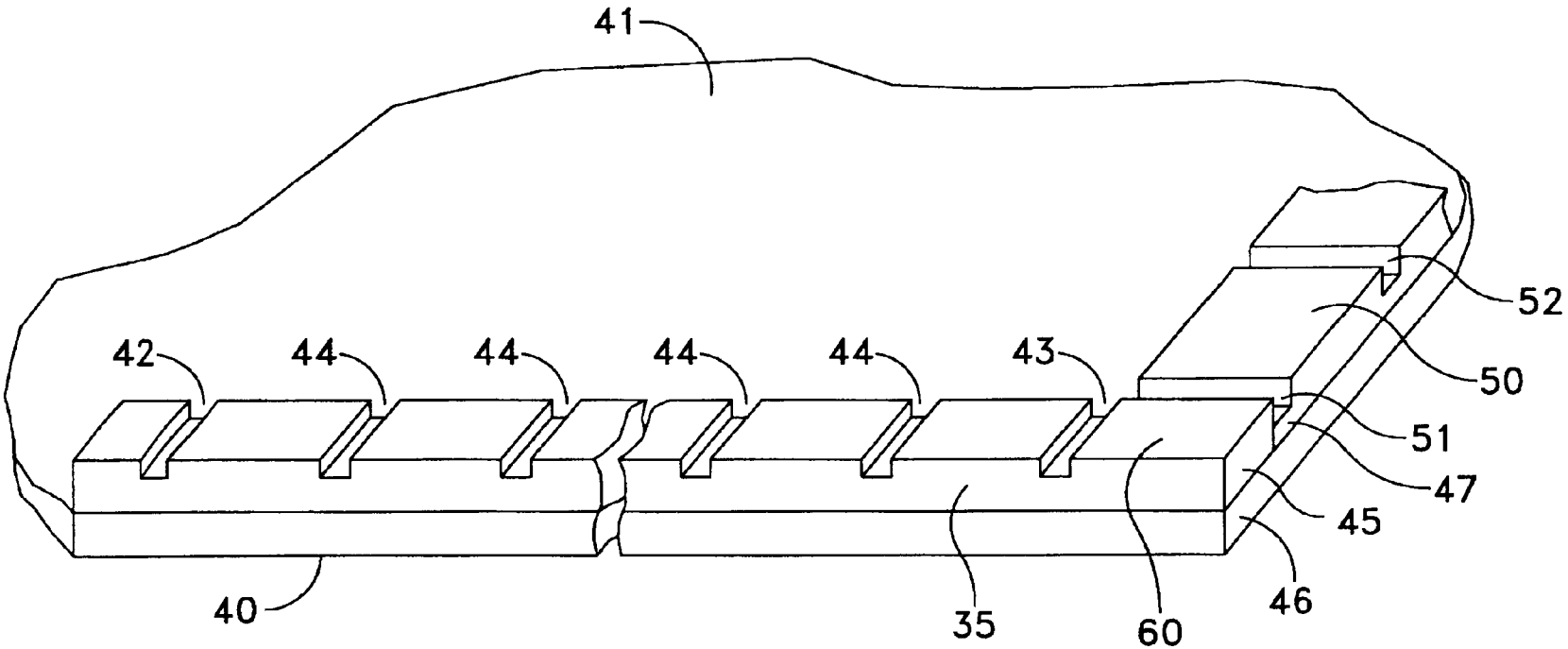
FIGS. 3 through 5 depict the details of a framing corner structure constructed in accordance with this invention.

Each of the bottom plate 35 and the upper plate 34 is formed with transverse notches. Referring specifically to FIG. 3, the bottom plate 35 has end notches 42 and 43 and intermediate notches 44. Typically the notches will be spaced along the bottom plate 35 at standard spacings, such as 12", 16" or 24" on center with each other and with notches 42 and 43. For preengineered lumber it will be apparent that the forming of these notches is readily facilitated for optimal positioning of the various studs and corner structures for specific structure details.

In accordance with this invention, the studs 36 have a width and a thickness. As known, two-by-fours have a nominal thickness and an actual or measured thickness. Assuming that t represents the final thickness of a plate in accordance with this invention, $t_{act}$ represents the measured thickness of a normal plate, and $d_{notch}$ represents the desired notch depth, then $$t=t_{act}+d_{notch}$$

Thus if a frame normally would comprise studs and plates formed of conventional two-by-fours, top and bottom plates, such as the top and bottom plates 34 and 35, in accordance with this invention would have a final thickness t, equal to the measured thickness of a two-by-four (i.e., $t_{act}$=1½") the notch depth (e.g., $d_{notch}$=½"). That is, the final thickness of the plate in accordance with this invention will be 2".

As will now be apparent, each plate has the same strength as it would have if the studs were merely butted. However, the overall frame retains the increased structural integrity afforded the notches. Moreover, the structure uses standard length studs because the stud length is the same as it would be if the studs were butted to conventional plates.

Referring again to FIG. 3, the bottom plate 35 terminates at a right end 45 flush with an edge 46 of the floor 41 that extends at right angles to the front edge 40. A side 47 of a bottom plate 50 is flush with the flooring edge 46 and an end abuts a surface of the bottom plate 35. The bottom plate 50 has a rabbet at that end to form an end notch 51 with the plate 35. Intermediate notches 52 are formed along the remainder of the length of the second bottom plate 50. Top plates having identical constructions to each of the bottom plates 35 and 50 are spaced above the bottom plates 35 and 50 respectively. They carry the intermediate studs 36 of FIG. 2 in vertical, parallel spaced relationships, again typically at 12", 16" or 24" on center. The studs then can be affixed to the plates by any conventional means such as end nailing, toe nailing or by brackets and nails or screws.

Figure 4:
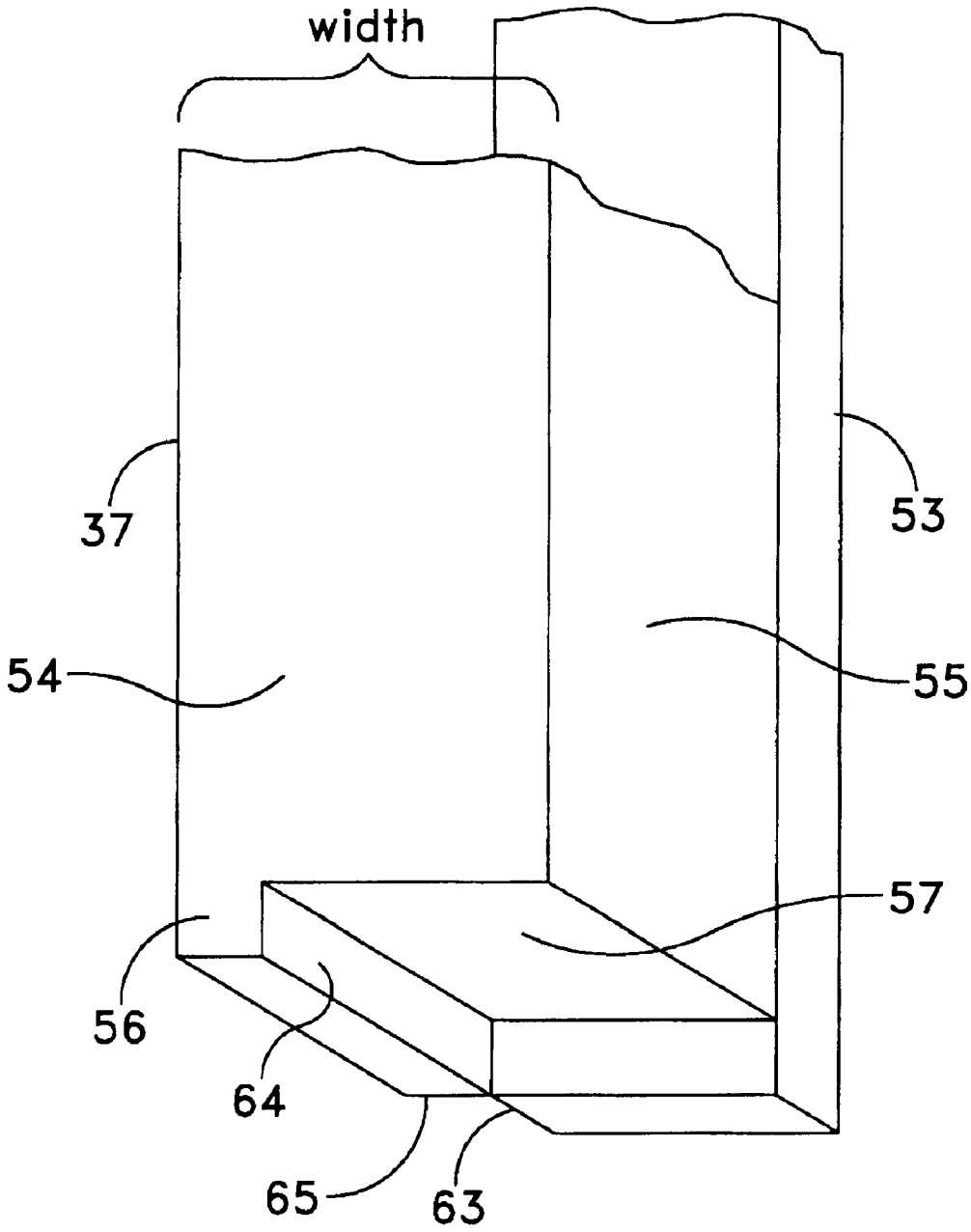
Figure 5:
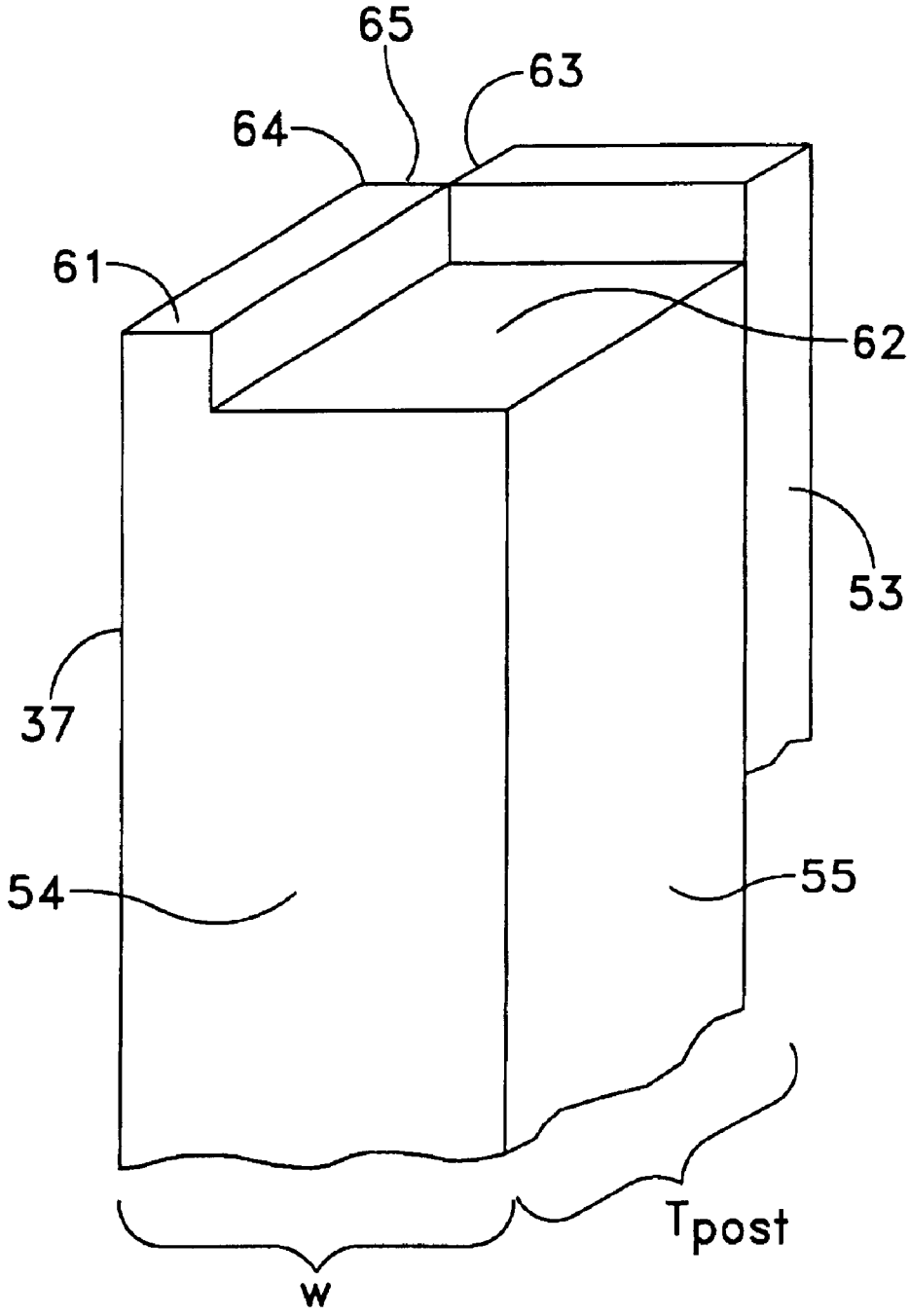

Each corner, such as the corner 33 in FIG. 2 includes two components in the form of a corner post, like the corner post 37, and a sistered stud, like the stud 53. Referring to FIGS. 4 and 5, the post 37 has a width measured across a side 54 and a thickness across the side 55. The width across the side 54 is equal to the thickness of a stud plus the width of a standard stud. For example, the side is 5" across based upon a 1½" stud thickness and a 3½" stud width. The thickness as measured across the side 55 corresponds to the finished width of the bottom plate for example, 3½" for two-by-four plates and 5½" for two-by-six plates.

FIG. 4 is a perspective of the bottom end of this structure. The post 37 includes a bottom tongue 56 with a thickness as measured across the surface 54 that corresponds to a standard stud thickness (i.e., 1½") and a depth which is a predetermined notch depth (e.g., ½"). The remainder of the corner post 37 forms a bottom planar surface 57. When the post 37 is positioned with the tongue 56 in the notch 43, the horizontal or planar surface 57 rests on a platform 60 shown in FIG. 3 bounded by the notches 43 and 51.

FIG. 5 represents the top end of the post 54 that has an analogous structure. That is, at the top end a tongue 61 extends past a top surface 62. The tongue 61 fits into a slot in a top plate corresponding to the slot 43 in the bottom plate 35 and the surface 62 abuts the surface formed in the top plate between the end slot and the end of the plate.

Referring again to FIGS. 4 and 5, the corner structure additionally includes the stud 53 that lies in the notch 51 shown in FIG. 2 and extends to a corresponding notch in a top plate. Typically the stud 53 is sistered to the post 37.

Referring now to FIGS. 4 and 5, this structure provides improved corner nailing surfaces. Specifically, the edge 63 of the stud 53 terminates in a plane that is coplanar with inside surfaces 64 of the tongue 61 of FIG. 5 and the tongue 56 of FIG. 4. As a result the edge surface 63 and a surface 65 on the post 37 extending beyond the stud 53, to the left in FIGS. 4 and 5, and form surfaces that is at right angles to the surface 63. The surfaces 63 and 65 then produce vertical nailers having full stud thickness (e.g., 1½").

With this corner construction, the interfitted tongues and notches to minimize any risk of failure due to twisting. As the post 37 is a single post, time otherwise spent building up such a structure with two-by-four lumber is eliminated. In addition, finish carpenters have full width nailing areas at each corner. All these advantages occur within a footprint that corresponds to the footprint of a conventional frame structure.

Figure 6:
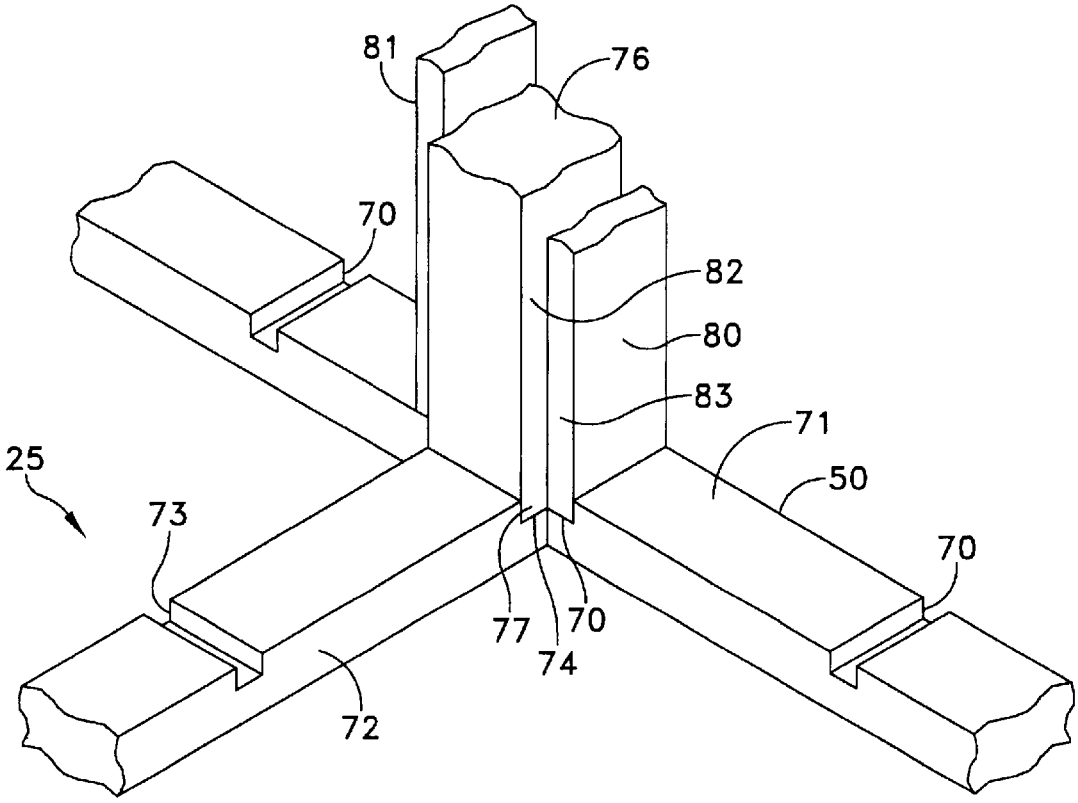
FIG. 6 depicts the detail of this invention as applied to an intersecting wall.

FIG. 1 depicts an intermediate wall 25 extending into the structure 10 from the side of the house between the windows 26 and 27. Specifically this intermediate wall 25 extends from the bottom plate 50 with its standard spaced notches 70 and top surface 71 as shown in FIG. 6. The framing for the intermediate wall includes a bottom plate. 72 with a construction similar to the bottom plate 50 that extends at right angles to the bottom plate 50. The bottom plate 72 is shown with an intermediate notch 73 and a rabbet to form a notch 74 where the end of the plate 72 butts against the plate 50.

A post 76 having the same construction as the post 37 positions a tongue 77 in the notch,74 so that the remainder of the post 76 overlies the plate 80. In this case the desired intermediate wall location places the post 76 adjacent one of the standard notches 70. This notch captures a stud 80 that is sistered to the post 76. Another sistered stud 81 butts against a top surface 71 of the bottom plate 50. A corresponding notch in the upper plate captures the other end of the stud 80. The stud 81 is conventionally nailed to the bottom plate 50 and corresponding top plate.

With this construction a surface 82 of the post 76 extending toward the midwall 25 and a surface 83 on the stud 80 form perpendicular nailing surfaces having full stud thickness. Similar nailing surfaces are formed by the post 76 and the stud 81. Thus the advantages achieved by the corner structure shown with respect to FIGS. 4 and 5 are also readily achieved at the position of a midwall such as shown in FIG. 6.

It may be desired to locate the intermediate wall at some other location along the wall 25 such that a post, like the post 76, is not adjacent a notch, like the notch 70. In that situation, the post 76, by virtue of the interlocking tongue 77 and notch 74, still provides many of the advantages of this invention even though sister studs, like the studs 80 and 81 do not sit in a notch.

Figure 7:
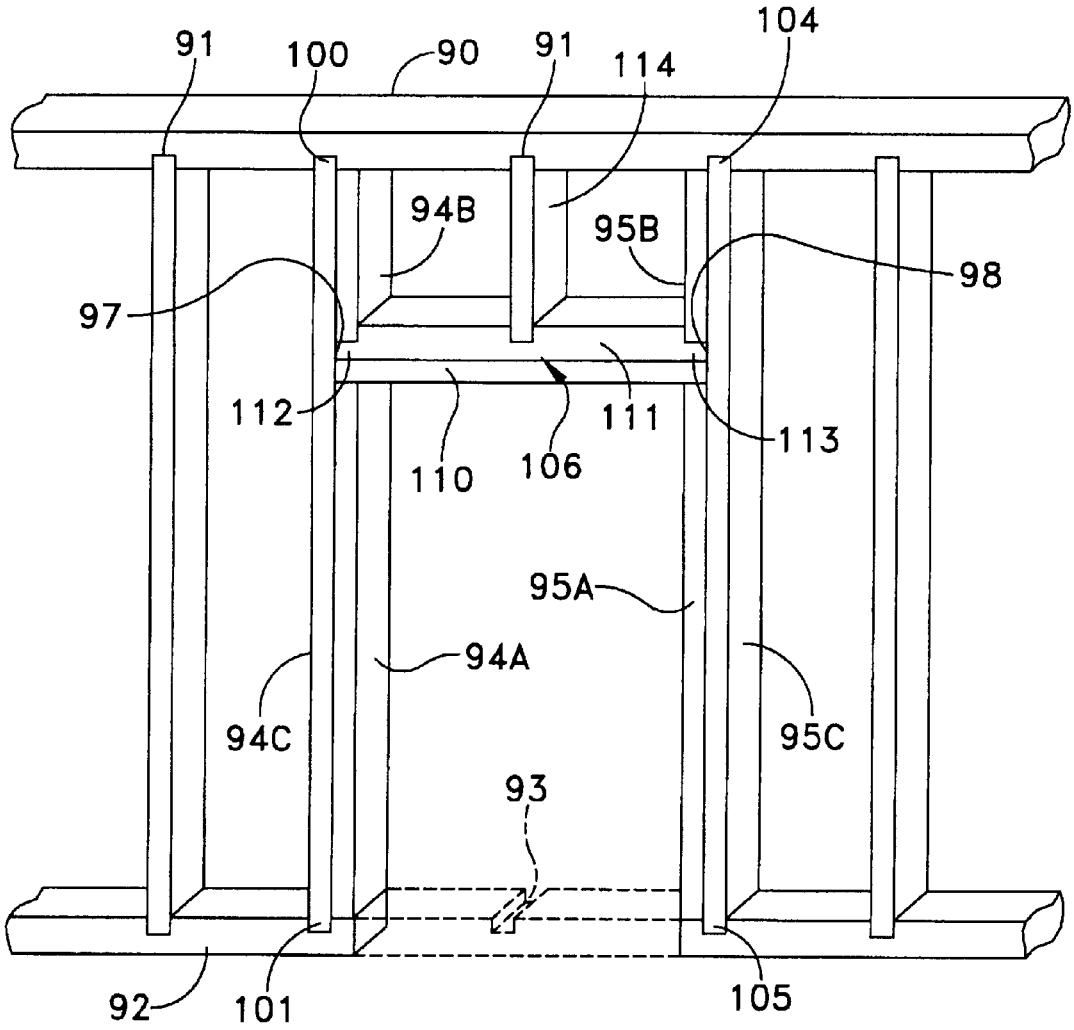
FIG. 7 depicts framing for a door or like opening in accordance with this invention.

The flexibility of this system can also be appreciated by examining the use of plates, such as the plates 35, in framing doors and windows in a rectangular opening through a wall. FIG. 7, for example, depicts framing with a top plate 90 having notches 91 and a bottom plate 92 having aligned notches 93. Cripples 94A and 95A form the side frame members for a door opening and are sistered to a stud 94C with a vertical space or notch 97 between the cripples 95A and 95B at door height. The stud 94C spans the upper and lower plates and, in this embodiment, is seated in the notches 100 and 101 in the top and bottom plates 90 and 92, respectively. Likewise the stud 95C is captured in notches 104 and 105 in the top plate 90 and bottom plate 92, respectively.

An intermediate horizontal header 106 defines the top of the door frame opening and sits in the notches 97 and 98. The header 106 comprises a standard two-by-four lower header plate 110 and an upper header plate 111 formed from a portion of a plate, like the plate 35. The ends of the plate 110 and tongues 112 and 113 formed by portions of the plate 111 that are coextensive with a notch position fit into the spaces 97 and 98 above the cripples 94A and 95A. The elevation of the spaces 97 and 98 positions the bottom surface of the header 110 at the correct door frame height. An intermediate cripple 114 can mount in aligned notches in the upper member 90 and the upper header plate 111.

FIG. 7 also depicts a portion of the plate 92 in phantom. Typically after the door frame is completed, the portion of the plate 92 between the cripples 94A and 95A will be removed.

Figure 8:
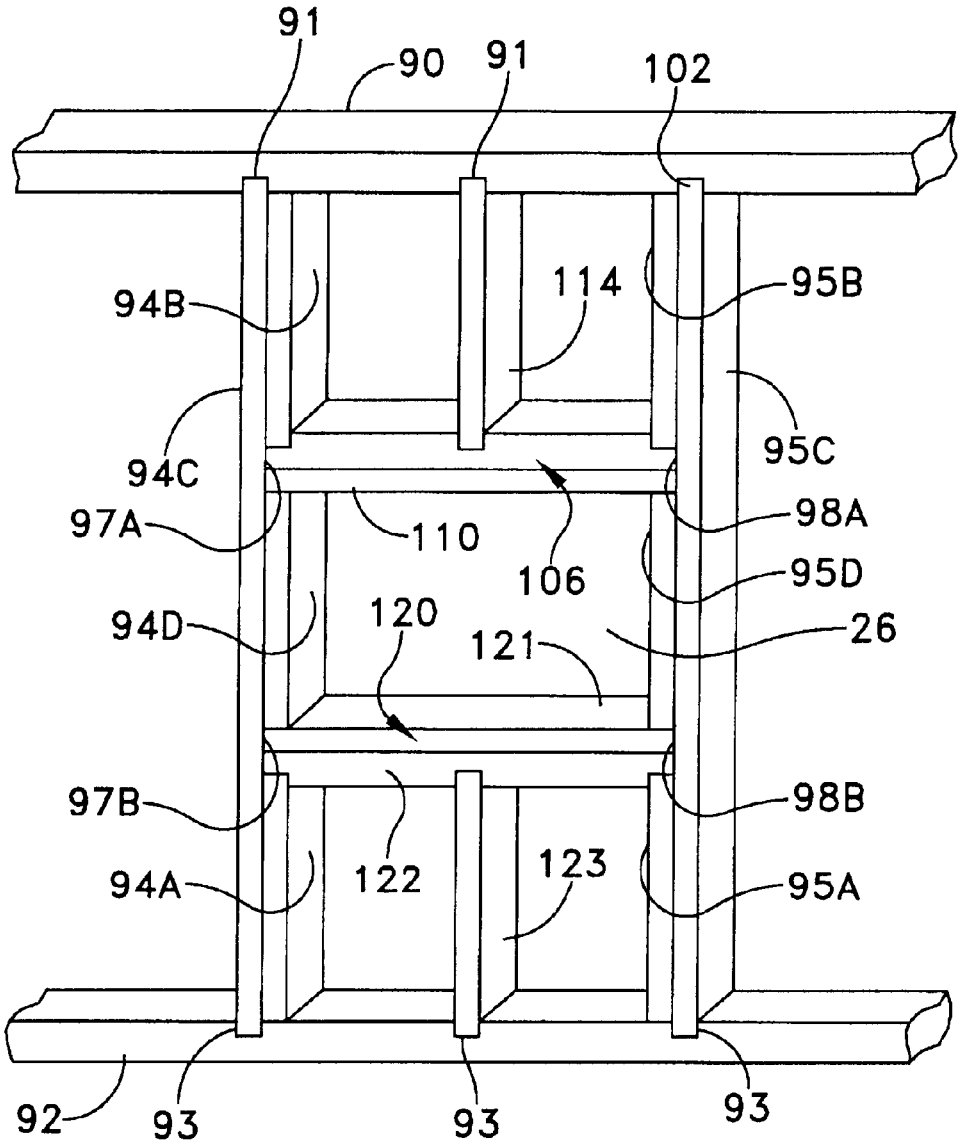
FIG. 8 depicts framing for a window or like opening in accordance with this invention.

FIG. 8 depicts framing for a window, such as the window 26 in FIG. 1. Still referring to FIG. 8, but using the same reference numbers as shown in FIG. 7 for like members, the window 26 will be located between the upper plate 90 and lower plate 92. Studs 94C and 95C extend the full height between the upper and lower plates 90 and 92 and terminate in corresponding notches 91 and 93. Bottom and top cripples 94A and 94B and an intermediate cripple 94D define upper and lower spaces 97A and 97B. Similarly bottom and top cripples 95A and 95B and an intermediate cripple 95D define upper and lower spaces 98A and 98B.

A header 106 includes a horizontal two-by-four 110 spanning the spaces 97A and 98A and carrying an upper header plate 110. The bottom surface of the header 106 then is located at the top of desired framing opening as also shown in FIG. 7. Another cripple 114 can extend between a notch formed in the header 106 and a corresponding notch 91 in the upper header 90.

A lower header 120 defines the bottom of the window opening and comprises an upper two-by-four 121 and a lower header plate 122 spanning the spaces 97B and 98B. The upper horizontal surface of the lower header 121 is positioned by locating the spaces 97B and 98B so that they are at the bottom of the desired framing opening for the window. In this particular embodiment another cripple 123 extends from an intermediate notch 93 to the corresponding notch in the lower header plate 122.

As will be apparent from FIGS. 7 and 8, the use of the header 106 as a doorway header or upper header in a window and the header 120 as a lower header for a window provide several advantages. The combination of the notches and studs aids in the prevention of twisting. The use of the plates 111 and 121 having a common construction with other plates, such as plate 35 in FIG. 2, minimizes the number of discrete components required. This helps to reduce construction costs.

As may now be apparent, each of these components, particularly the notched plates, can be constructed to standard sizes and with standard spacings or with custom spacings as required. The formation of notches in headers or plates according to this invention provides the structural integrity required to minimize potential for damage under severe wind loads without lessening the inherent integrity of the sill structure.

In accordance with this invention a wooden structure, such as the structure shown in FIG. 1, has top and bottom wooden plates formed like the wooden plates 35 and 47 in FIG. 3 and studs like the intermediate studs 36 in FIG. 2. Each of those studs has a standard length, width and thickness, such as a two-by-four that is 8 feet long. Each plate has a length and a width corresponding to the width of the studs. However, the plates are formed from lumber have a nominal thickness specification, such as associated with two-by-fours or two-by-sixes. Each of the plates, however, has a plurality of transverse notches, such as the notches 44 in FIG. 3, to a predetermined depth. The actual plate thickness in accordance with this invention corresponds to the specified nominal plate thickness plus the depth of the notch. A two-by-four with 1.5" thickness and 0.5" deep notch has an actual plate thickness of 2 inches. AS shown in FIG. 2, both upper plates 34 and lower plates 35 have notches with corresponding spacings so that the studs are vertical and parallel.

In addition the framing components of this invention include corner posts. Each post has a thickness corresponding to the width of an abutting plate and a width corresponding to the width of the abutting plate plus the thickness of a stud. That is, as shown in FIGS. 4 and 5, the width of the post 37 corresponds to the thickness of a tongue 61, that corresponds to the thickness of a conventional stud, such as stud 53 that is coextensive with the flat area 62, plus the width of a stud. In accordance with this invention, the tongue 61 and extensions of sistered studs are captured in corresponding notches.

In addition these framing components are adapted for framing openings with one or two headers acting to define the upper and lower limits of the opening. The upper and lower headers include plates, such as the plate 35 in FIG. 2, to engage cripples and form strong structures with conventional studs. Spacing plates, such as plates 34 and 35 in FIG. 2 and plates 90 and 92 in FIGS. 7 and 8.

Therefore it will be apparent from this disclosure that many variations can be made to the specifically disclosed structure shown and described with respect to FIGS. 1 through 8. For example, the description refers to specific nominal lumber sizes, such as two-by-four and two-by-six lumber. Other sizes might also be used. In other environments the total plate thickness as some other nominal lumber thickness plus notch depth can be used, for example, in sills and caps. Any of the variety of fastening modalities can connect the various elements together. The drawings depict the framing with single upper and lower plates. In a particular application, double plates might also be used.

Thus, while this invention has been disclosed in terms of certain embodiments, it will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A system for framing a wooden structure with wooden plates formed from lumber characterized by a specified nominal thickness specification that is greater than the measured thickness and studs wherein the studs have a length, a width and thickness and the plates have a length and have a width corresponding to the width of the studs, said plates being formed from lumber, each of said plates having a plurality of transverse notches across the width of the plate for receiving the end of a stud, said notches having a predetermined depth, said plate having a final thickness equal to at least the sum of the measured thickness and the depth of the notch whereby the end of each stud is held within a notch when the framing is constructed thereby to produce a structure with increased structural integrity.

2. A framing system as recited in claim 1 wherein said notches in different ones of said plates have corresponding spacings.

3. A framing system as recited in claim 1 wherein the lumber forming the plates has a final thickness corresponding to a standard rough lumber dimension and the notch depth is equal to the difference between the specified nominal thickness and rough lumber dimension for the thickness.

4. A framing system as recited in claim 1 additionally comprising posts, each of said posts having a thickness corresponding to the width of an abutting plate and a width corresponding to the width of the abutting plate plus the thickness of a stud.

5. A framing system as recited in claim 4 wherein said posts additionally have extensions at the ends thereof and said plates have notches therein for receiving said post extensions.

6. A framing system as recited in claim 5 wherein said posts are positioned at corners and said abutting plates have transverse notches spaced from the plate ends thereby to receive the post extensions and overlie the ends of the posts.

7. A framing system as recited in claim 5 wherein a structure has top and bottom plates and has a framed rectangular opening therethrough and wherein the framed opening has a stud spanning the top and bottom plates adjacent each side of the opening and an upper header spanning said studs to define the top of the opening, each of said studs having spaced cripples to form counterfacing notches to receive said upper header, said upper header comprising a plate having a notch facing said top plate.

8. A system as recited in claim 7 wherein a lower header defines the bottom of the opening and wherein said cripples define counterfacing notches to receive the lower header, said lower header comprising as plate having a notch facing said bottom plate.

9. A framing system as recited in claim 5 wherein said framing defines a first wall extending from an intermediate position along a second wall, said second wall having a post positioned at the location of the position of the first wall and said plates of the first wall have notches formed at the ends abutting the second wall for receiving a stud that additionally attaches to the post.

10. A framing system as recited in claim 8 wherein said intermediate post has a thickness that corresponds to the width of a plate plus the twice the thickness of a stud.

* * * * *